US007213938B2

(12) United States Patent
Brondt et al.

(10) Patent No.: US 7,213,938 B2
(45) Date of Patent: May 8, 2007

(54) ELECTRICAL LIGHTING FIXTURE WITH SUSPENSION ASSEMBLY

(75) Inventors: Gary W. Brondt, Cheney, WA (US); Wilton L. Fowler, Jr., Veradale, WA (US)

(73) Assignee: Hubbell Incorporated, Orange, CT (US)

( * ) Notice: Subject to any disclaimer, the term of this patent is extended or adjusted under 35 U.S.C. 154(b) by 94 days.

(21) Appl. No.: 10/815,993

(22) Filed: Apr. 2, 2004

(65) Prior Publication Data

US 2004/0218393 A1 Nov. 4, 2004

Related U.S. Application Data

(60) Provisional application No. 60/459,261, filed on Apr. 2, 2003.

(51) Int. Cl.
*F21S 4/00* (2006.01)
*F21V 21/16* (2006.01)

(52) U.S. Cl. ..... 362/225; 362/407; 362/368; 362/403; 362/391; 362/147; 362/217; 248/317

(58) Field of Classification Search ..... 362/225, 362/407, 368, 248, 403, 391, 147, 217, 362; 248/404, 63, 407, 317, 323, 327; D26/80–82, D26/72, 90

See application file for complete search history.

(56) References Cited

U.S. PATENT DOCUMENTS 2,413,505 A * 12/1946 Kilduff et al. ..... 362/225
2,567,014 A * 9/1951 Fine et al. ..... 362/217
2,678,380 A * 5/1954 Westby ..... 362/220
3,591,798 A * 7/1971 Florence ..... 362/225
4,138,716 A 2/1979 Muhlethaler
4,613,930 A * 9/1986 Ambasz ..... 362/223
4,726,781 A 2/1988 Bernhart
5,090,145 A 2/1992 Chiang
5,111,370 A 5/1992 Clark
5,658,066 A 8/1997 Hirsch
6,530,674 B2 3/2003 Grierson
2003/0058640 A1* 3/2003 McAlpin ..... 362/225
2003/0137835 A1 7/2003 Mier-Langner
2003/0221296 A1 12/2003 Gijsel

* cited by examiner

*Primary Examiner*—Renee Luebke
*Assistant Examiner*—Evan Dzierzynski
(74) *Attorney, Agent, or Firm*—Marcus R. Mickney; Mark S. Bicks; Alfred N. Goodman

(57) ABSTRACT

A lighting fixture that includes an elongated housing supporting at least one lamp and including a wall and an opening opposite the wall. The wall includes a first tongue formed therein. A first suspension cable is coupled with the housing. The suspension cable includes opposite first and second ends. The first end of the suspension cable has a loop engaging the first tongue of the wall of the housing and the second end of the suspension cable is adapted to engage a support to suspend the housing from the support.

28 Claims, 2 Drawing Sheets

ELECTRICAL LIGHTING FIXTURE WITH SUSPENSION ASSEMBLY

CROSS-REFERENCE TO RELATED APPLICATION

This application claims the benefit under 35 U.S.C. § 119(e) of U.S. Provisional Application Ser. No. 60/459,261, filed Apr. 2, 2003, which is hereby incorporated by reference in its entirety.

FIELD OF THE INVENTION

The present invention relates to an electrical lighting fixture with a suspension assembly. More specifically, the suspension assembly includes a retention tongue that facilitates engagement of the lighting fixture with cables suspended from a ceiling or beam. Still more particularly, the suspension assembly of the present invention is adapted to receive support cables without modifying or disassembling the lighting fixture.

BACKGROUND OF THE INVENTION

Conventional lighting fixtures for retail and industrial applications are often installed or mounted by being suspended from a ceiling. Such installation of conventional lighting fixtures requires multiple steps including engagement of cables at either end of the fixture housing using a conventional fastener and subsequently attaching the cables to the ceiling. Access to the interior of the lighting fixture housing must be provided to attach the cables to each fixture end. More specifically, the ends of the fixture are removed allowing access to the cables extending through the housing top wall, and the cable ends are fastened to the housing. Subsequent to assembling the cables with each end of the lighting fixture, the fixture ends are reattached and the cables are mounted to the ceiling, thereby suspending the fixture.

Examples of conventional suspended lighting fixtures include U.S. Pat. No. 6,530,674 to Grierson et al., U.S. Pat. No. 5,658,066 to Hirsch, and U.S. Pat. No. 4,726,781 to Bernhart et al., the subject matter of each of which is hereby incorporated by reference.

A need exists for an improved suspension assembly for a lighting fixture.

SUMMARY OF THE INVENTION

Accordingly, an object of the present invention is to provide a lighting fixture that is easily suspended from a ceiling or beam in one step.

Another object of the present invention is to provide a lighting fixture with a suspension assembly that engages cables subsequent to suspending the cables from a support, such as a ceiling.

Yet another object of the present invention is to provide a lighting fixture that may be suspended from a support without the need for additional suspension or mounting parts, modification of the fixture, or disassembly of the lighting fixture.

The foregoing objects are basically attained by providing a lighting fixture, including an elongated housing supporting at least one lamp and including a wall and an opening opposite the wall, the wall having a first tongue formed therein; and a first suspension cable coupled with the housing, the suspension cable including opposite first and second ends, the first end of the suspension cable having a loop engaging the first tongue of the wall of the housing and the second end of the suspension cable adapted to engage a support to suspend the housing from the support.

The foregoing objects are also attained by providing a lighting fixture, including an elongated housing supporting first and second lamps and including a wall, an opening opposite the wall, and first and second reflectors for directing light from the lamps through the opening, the wall including opposing ends with first and second tongues formed therein, respectively; and first and second suspension cables coupled with the housing, each of the first and second suspension cables including opposite first and second ends, each of the first ends of the suspension cables having a loop engaging said first and second tongues, respectively, of said wall of said housing and said second ends of said suspension cables being adapted to engage a support to suspend the housing from the support.

The foregoing objects are also attained by a method of suspending a lighting fixture from a support, the lighting fixture including a housing supporting at least one lamp and having opposite first and second end caps, including the steps of inserting a first end of a first suspension cable between a wall of the housing of the lighting fixture and one of the first and second end caps; looping the first end of the first suspension cable around a first suspension member formed in the wall of the housing; and coupling a second end of the first suspension cable opposite the first end with a support thereby suspending the lighting fixture from the support by the first suspension cable.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
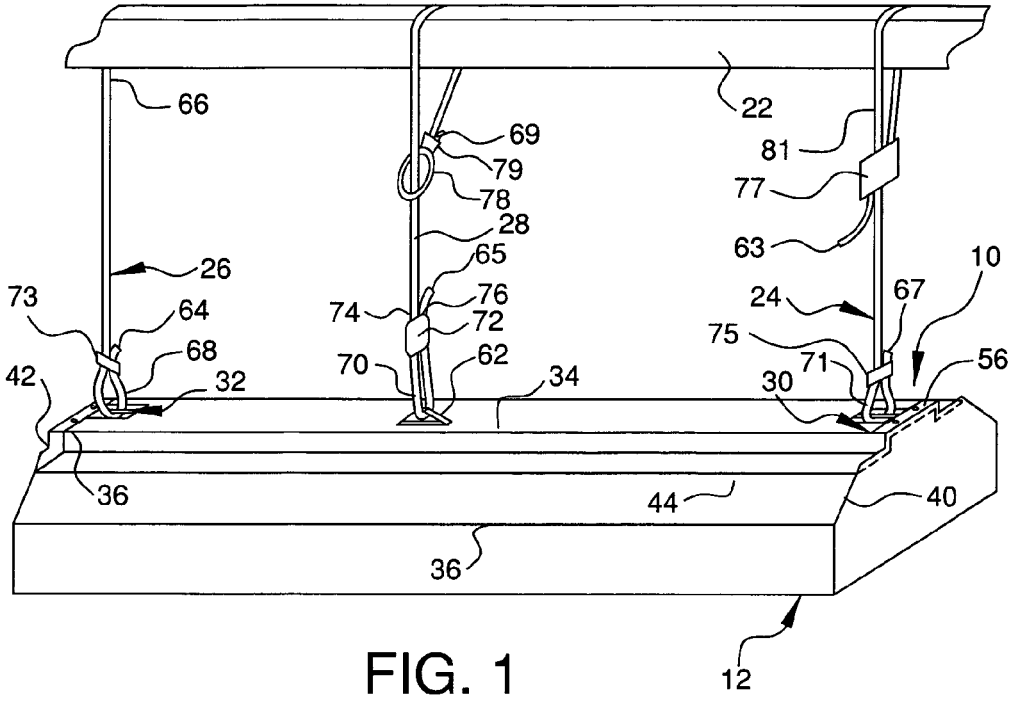
FIG. 1 is a perspective view of a lighting fixture in accordance with an embodiment of the present invention, showing the lighting fixture suspended from a support.

Referring to the FIGS. 1–6, a lighting fixture 10 in accordance with the present invention generally includes a decorative housing 12 that receives first and second parabolic louvers 14 and 16 formed of highly reflective material and that supports first and second lamps 18 and 20. Lamps 18 and 20 are preferably fluorescent. Lighting fixture 10 can be suspended from a support 22, such as a ceiling or beam, by suspension cables 24, 26 and 28. Suspension members 30 and 32 formed in fixture housing 12 facilitate engagement of the lighting fixture 10 with suspension cables 24, 26 and 28 without requiring additional suspension or mounting parts, modification of the fixture, or disassembly of the fixture. Also, louvers 14 and 16 and lamps 18 and 20 provide energy savings, excellent lumen maintenance, higher maintained lumens per watt, precise light distribution and control, and instant restrike and superior color rendering. Preferably, the housing is made of steel. The louvers are preferably made of an anodized aluminum.

Figure 4:
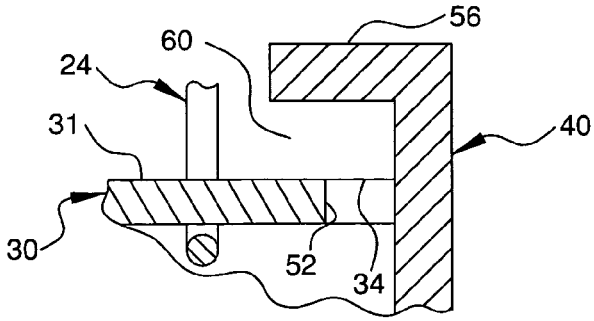
FIG. 4 is an elevational view in cross section along a longitudinal line of the lighting fixture of FIG. 3.
Figure 5:
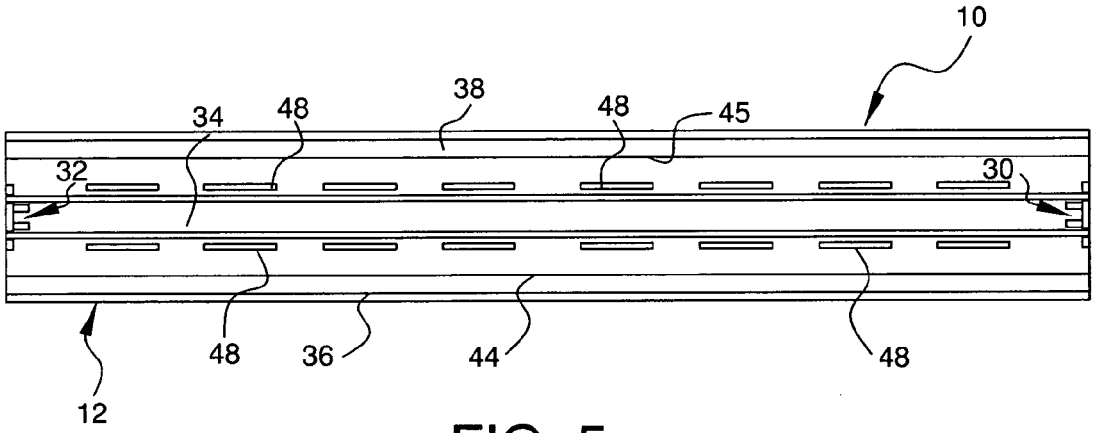
FIG. 5 is a top plan view of the lighting fixture of FIG. 1.

As shown in FIGS. 1 and 5, the housing 12 is elongated and has a top wall 34, first and second side walls 36 and 38 extending from the top wall 34, and first and second end walls or caps 40 and 42. Lamps 18 and 20 are supported within the housing 12 between the top wall 34 and the side walls 36 and 38, as shown in FIG. 5. Each of the side walls 36 and 38 has a stepped portion 44 and 45, respectively, defining an inner ballast compartment 46 disposed above louvers 14 and 16, as shown in FIG. 4. Stepped portions 44 and 45 of the side walls 36 and 38 may include a plurality of slots 48, as shown in FIG. 5, allowing uplighting from lamps 18 and 20 through the top wall 34. For example, two aligned rows of slots 48 may be disposed in stepped portions 44 and 45 adjacent the central ballast compartment 46, as shown in FIG. 5.

Figure 2:
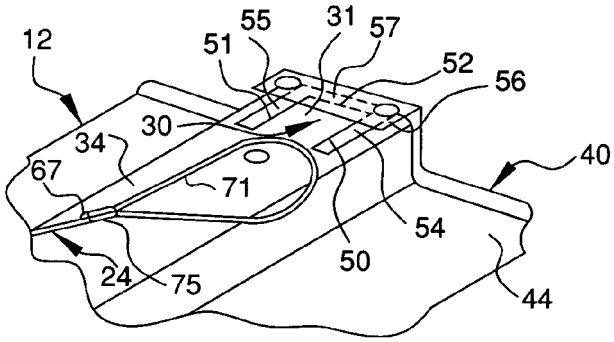
FIG. 2 is an enlarged partial perspective view of the lighting fixture of FIG. 1, showing a suspension member before being connected to the lighting fixture.
Figure 3:
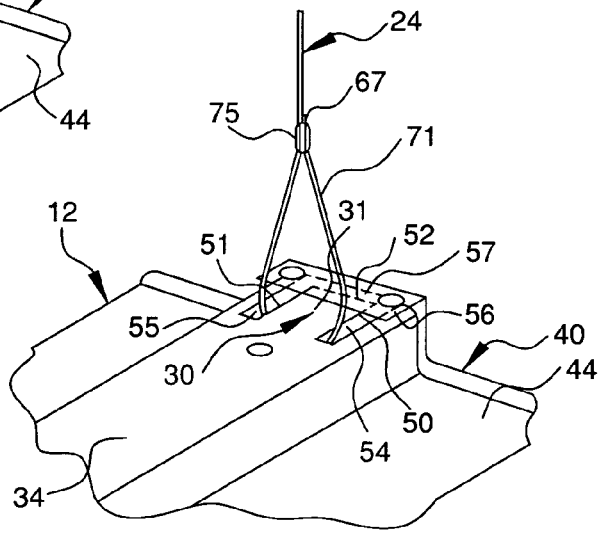
FIG. 3 is an enlarged partial perspective view of the lighting fixture of FIG. 2, showing the suspension member connected to the lighting fixture.

As shown in FIG. 1, first and second suspension members 30 and 32 of lighting fixture 10 are formed in the top wall 34 near each end cap 40 and 42, respectively, for engaging suspension cables 24 and 26. First and second suspension members 30 and 32 are substantially identical, so reference will be made to only the first suspension member 30. The first suspension member 30 has a tongue 31, including opposite sides 50 and 51 and a distal end 52 extending between sides 50 and 51, as shown in FIGS. 2 and 3. First suspension member 30 may be formed integrally with the top wall 34 or may be separately formed and attached to the top wall. First and second slots 54 and 55 are formed adjacent sides 50 and 51 of the first suspension member 30, and a third slot 57 is formed between distal end 52 of the tongue 31 and the end cap 40, as shown in FIGS. 2 and 3. The end cap 40 includes a tab 56 that extends above the top wall 34 and over the distal end 52 of the tongue 31 of the suspension member 30, as shown in FIGS. 1–4. A vertical gap 60 is defined between the tongue 31 and the tab 56 of the end cap 40, as shown in FIG. 4. Any number of suspension members 30 and 32 may be formed in the housing top wall 34 and disposed anywhere in the top wall. Alternative suspension members may be used with the lighting fixture 10, such as a central hook 62 disposed in the top wall 34 for engaging suspension cable 28, as shown in FIG. 1.

Suspension cables 24, 26 and 28 engage a suspension member at a first end and a support 22 at a second end, as shown in FIGS. 1–6. Each suspension cable 24, 26 and 28 has a first end 64, 65 and 67 for engaging suspension members 30, 32 and 62 and an opposite second end 66, 69 and 63 for engaging the support 22. Each first end 64 and 67 of cables 24 and 26 includes a loop 68 and 71 for looping around tongues 31 of suspension members 30 and 32 of fixture housing 12, as shown in FIGS. 1 and 3. The loops 68 and 71 may be preformed in the cable.

Similarly, the first end 65 of suspension cable 28 forms a loop 70 that engages a hook 62 on the top wall 34 of the housing 12. The loop 70 may be formed using a tether 72 or other tying device, as seen in FIG. 1. The tether 72 includes a cable entrance passageway 74 and a cable exit passageway 76. The first end 65 of cable 28 is inserted through the cable entrance passageway 74 and back through the cable exit passageway 76, thereby creating loop 70. The tether 72 locks loop 70 in place via a one-way lock (not shown). An adjustment tool (not shown) may be inserted into tether 72 to release or unlock tether 72 from cable 28 and allow adjustment of the length of cable 28. Substantially identical tethers 73, 75, 77 and 79 may also be used to form loops 68, 71, 81 and 78 in cables 24, 26 and 28 at the time of installation of the lighting fixture 10, as an alternative to preforming the loops.

Figure 6:
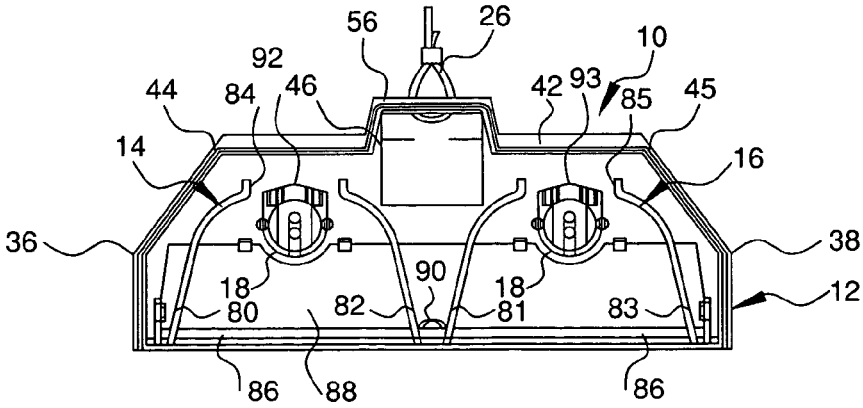
FIG. 6 is an end elevational view of the lighting fixture of FIG. 1 with the end cap removed, showing the interior of the fixture.

First and second parabolic louvers or reflectors 14 and 16 are disposed in fixture housing 12 adjacent one another with lamps 18 and 20 supported between louvers 14 and 16 and top wall 34 of housing 12, as shown in FIG. 6. Each louver 14 and 16 is elongated and has a length generally corresponding to the length of the housing 12, as shown in FIG. 6. Louver 14 has first and second stringers 80 and 82 forming a parabolic shape in cross section, and louver 16 has third and fourth stringers 81 and 83 forming a parabolic shape in cross section. A first slot 84 is defined between stringers 80 and 82 for receiving a first lamp 18, and a second slot 85 is defined between stringers 81 and 83 for receiving a second lamp 20. Each louver 14 and 16 includes an open bottom 86 for directing light from lamps 18 and 20 downwardly. Each louver 14 and 16 includes a plurality of downwardly extending baffles 88 for further directly light downwardly. Louvers 14 and 16 are coupled in an adjacent arrangement by clips 90. Louvers 14 and 16 provide precise control of the light from lamps 18 and 20 downwardly. Louvers 14 and 16 are preferably made of highly reflective material, such as a mirror type material.

Socket holders 92 and 93 are inset from respective end walls or caps 40 and 42 and support both lamps 18 and 20 and louvers 14 and 16. Each socket holder 92 includes catches (not shown) for supporting louvers 14 and 16. End caps 40 and 42 may be connected to housing 12 via a fastener, such as a stud. Light seals or gaskets may also be provided between end caps 40 and 42 and respective socket holders 92 to prevent leakage of light.

Assembly and Operation

Referring to FIGS. 1–6, lighting fixture 10 is suspended from support 22 by engaging suspension cables 24 and 26 with suspension members 30 and 32, respectively. Loops 71 and 68 of cables 24 and 26 are first inserted into gap 60 (FIGS. 2–4) defined between tab 56 of each respective end cap 40 and 42 and top wall 34 of fixture housing 12. Each loop 71 and 68 of cables 24 and 26 may then be inserted into first and second slots 54 and 55 of the suspension members 30 and 32 and looped onto tongue 31. The tongues 31 and the gaps 60 allow for easy and secure engagement of suspension cables 30 and 32 with lighting fixture 10 without modifying or disassembling the fixture housing 12.

Once loops 71 and 68 of each cable 24 and 26 are securely retained on suspension members 30 and 32, ends 63 and 66 of cables 24 and 26 opposite loops 71 and 68 are coupled to support 22 in a conventional manner. For example, end 63 of cable 24 may extend around support 22 forming loop 81 with a tether 71 locking the loop in place, as shown in FIG. 1. The length of cable 24 may be adjusted by unlocking tether 71. Alternatively, end 66 of cable 26 may be screwed or bolted into support 22, as shown in FIG. 1.

For additional support of lighting fixture 10, suspension cable 28 may also be used. First end 66 is extended through suspension member or hook 62 in the central portion of fixture housing 12, thereby forming a loop 70. Tether 72 closes loop 70 and locks cable 28 in place. Second end 69 of cable 28 is then attached to support 22 in any conventional manner, such as the attachment between cables 24 and 26 and the support 22. Alternatively, cable 28 may extend around support 22 and form a loop 78 around cable 28, as shown in FIG. 1. Tether 79 is used to lock the loop 78.

Lighting fixture 10 may be installed by first engaging cables 24 and 26 with fixture suspension members 30 and 32 and then coupling each cable 24 and 26 to support 22, as described above. Alternatively, cables 24 and 26 may be coupled to support 22 prior to engaging cables 24 and 28 with suspension members 30 and 32. For example, once cables 24 and 26 are secured to support 22, loops 71 and 68 of the first ends 67 and 64 of cables 24 and 26 may be looped around tongues 31. Suspension members 30 and 32 give the installer the option of either first coupling cables 24 and 26 with lighting fixture 10 and then suspending fixture 10, or coupling cables 24 and 26 with support 22 to suspend cables 24 and 26 and then coupling cables 24 and 26 with lighting fixture 10.

While a particular embodiment has been chosen to illustrate the invention, it will be understood by those skilled in the art that various changes and modifications can be made therein without departing from the scope of the invention as defined in the appended claims.

What is claimed is:

1. A lighting fixture, comprising:

a housing supporting a first lamp and including a wall formed integrally therewith and an opening opposite said wall, said wall including a first tongue being a unitary one piece extension thereof and extending from said wall at a fixed end to a free end thereof; and a first suspension cable coupled with said housing, said suspension cable including opposite first and second ends, said first end of said suspension cable having a first loop passable over said free end and extending transversely around said first tongue of said wall of said housing, said second end of said suspension cable being engageable with a support to suspend said housing from the support.

2. A lighting fixture according to claim 1, wherein said wall includes a second tongue being a unitary one piece extension thereof and extending from said wall at a fixed end to a free end thereof; and a second suspension cable includes a third end with a second loop being passable over said free end and extending transversely around said second tongue.

3. A lighting fixture according to claim 1, wherein said wall of said housing includes opposing ends; and said first tongue is disposed adjacent one of said opposing ends.

4. A lighting fixture according to claim 1, wherein said housing includes an end cap engaged with an end of said wall, said end cap having a tab spaced from and covering a portion of said first tongue adjacent said free end.

5. A lighting fixture according to claim 1, wherein said housing includes first and second end caps engaging opposing ends of said wall of said housing.

6. A lighting fixture according to claim 1, wherein said housing supports a plurality of fluorescent lamps.

7. A lighting fixture according to claim 1, wherein said wall of said housing includes an elongated slot allowing light from said lamp to shine therethrough away from said opening of said housing.

8. A lighting fixture according to claim 1, wherein a first parabolic reflector is coupled within said elongated housing and aligned with said first lamp for directing light in a direction through said opening of said housing, said first parabolic reflector including a plurality of baffles extending towards said opening of said housing.

9. A lighting fixture according to claim 8, wherein a second parabolic reflector is coupled with said housing adjacent said first parabolic reflector; and a second lamp is supported in said housing and aligned with said second parabolic reflector.

10. A lighting fixture according to claim 1, wherein said tongue and said wall are substantially coplanar.

11. A lighting fixture according to claim 1, wherein said tongue has substantially parallel side edges extending between said fixed end and said free end, said side edges and said free end being spaced from said wall by a slot.

12. A lighting fixture, comprising:

an elongated housing supporting first and second lamps and including a wall formed integrally therewith, an opening opposite said wall, and first and second reflectors for directing light from said first and second lamps through said opening, said wall including opposing ends with first and second tongues formed integrally therewith, each of said first and second tongues being a unitary one piece extension thereof and extending from said wall at a fixed end to a free end thereof; and first and second suspension cables coupled with said housing, each of said first and second suspension cables including opposite first and second ends, each of said first ends of said suspension cables having a loop passable over said free ends and extending transversely around said first and second tongues, respectively, of said wall of said housing, said second ends of said suspension cables being engageable with a support to suspend said housing from the support.

13. A lighting fixture according to claim 12, wherein said housing includes first and second end caps engaging opposing ends of said wall of said housing; and each of said end caps including a tab spaced from and covering a portion of said first and second tongues, respectively.

14. A lighting fixture according to claim 12, wherein said wall of said housing includes a plurality of elongated slots allowing light from said lamps to shine therethrough away from said opening of said housing.

15. A lighting fixture according to claim 12, wherein first and second parabolic reflectors are coupled within said elongated housing and aligned with said first and second lamps, respectively, for directing light in a direction through said opening of said housing, and each of said parabolic reflectors including a plurality of baffles extending towards said opening of said housing.

16. A lighting fixture, comprising:

a housing supporting first and second lamps and including a wall, an opening opposite said wall, and first and second reflectors for directing light from said first and second lamps through said opening;

a first tongue formed in said wall adjacent a first end and a second tongue formed in said wall adjacent a second end; each of said tongues having first and second slots extending inwardly along said wall from said first and second ends and distal ends adjacent said first and second ends;

first and second end caps engaging first and second ends of said wall of said housing, each of said end caps having a tab spaced from and covering a portion of said first and second tongues, each of said distal ends of said first and second tongues being spaced from said first and second end caps;

first and second suspension cables coupled with said housing, each of said first and second suspension cables including opposite first and second ends, each of said first ends of said suspension cables having a loop engaging said first and second tongues and said first and second slots, respectively, of said wall of said housing and said second ends of said suspension cables being adapted to engage a support to suspend said housing from the support.

17. A lighting fixture according to claim 16, wherein said first and second tongues are integrally formed with said wall of said housing.

18. A lighting fixture according to claim 16, wherein said wall of said housing includes a plurality of elongated slots allowing light from said lamps to shine therethrough away from said opening of said housing.

19. A lighting fixture according to claim 16, wherein first and second parabolic reflectors are coupled within said elongated housing and aligned with said first and second lamps, respectively, for directing light in a direction through said opening of said housing, and each of said parabolic reflectors including a plurality of baffles extending towards said opening of said housing.

20. A method of suspending a lighting fixture from a support, the lighting fixture including a housing supporting at least one lamp and having opposite first and second end caps, comprising the steps of:

inserting a first end of a first suspension cable between a wall of the housing of the lighting fixture and one of the first and second end caps;

looping the first end of the first suspension cable around a first suspension member formed integrally with the wall of the housing; and coupling a second end of the first suspension cable opposite the first end with a support thereby suspending the lighting fixture from the support by the first suspension cable.

21. A method according to claim 20, further comprising the steps of:

inserting a third end of a second suspension cable between a wall of the housing of the lighting fixture and the other of the first and second end caps;

looping the third end of the second suspension cable around a second suspension member formed integrally with the wall of the housing; and coupling a fourth end of the second suspension cable opposite the first end with the support, thereby suspending the lighting fixture from the support by the second suspension cable.

22. A method according to claim 21, wherein the first and second suspension members are tongues.

23. A method according to claim 22, wherein each of the end caps includes a tab spaced from and covering a portion of the first and second tongues, respectively.

24. A method according to claim 20, wherein a parabolic reflector is coupled within the housing and aligned with the lamp, respectively, for directing light in a direction through an opening of the housing, and the parabolic reflector including a plurality of baffles extending towards the opening of the housing.

25. A method according to claim 20, wherein the step of coupling the second end of the second suspension cable opposite the first end with the support occurs prior to inserting the first end of the second suspension cable between the wall of the housing of the lighting fixture and the other of the first and second end caps.

26. A lighting fixture, comprising:

a housing supporting a first lamp and including a wall and an opening opposite said wall, said wall having first and second slots with a first tongue located therebetween, said first tongue having a free distal end; and a first suspension cable coupled with said housing, said suspension cable including opposite first and second ends, said first end of said suspension cable having a first loop slidably receivable in said first and second slots and on said first tongue of said wall of said housing and said second end of said suspension cable adapted to engage a support to suspend said housing from the support.

27. A lighting fixture according to claim 26, wherein said wall includes third and fourth slots with a second tongue located therebetween, said second tongue having a free distal end; and a second suspension cable includes a third end with a second loop slidably receivable in said third and fourth slots and on said second tongue.

28. A lighting fixture according to claim 27, wherein said first and second tongues are integrally formed with said wall of said housing.

* * * * *